US008863446B2

(12) United States Patent
Strachan et al.

(10) Patent No.: US 8,863,446 B2
(45) Date of Patent: Oct. 21, 2014

(54) FOLDABLE STRUCTURE

(75) Inventors: Zachery K. Strachan, Portland, OR (US); Thomas Casto, Mead, WA (US)

(73) Assignee: ZKS, LLC, Portland, OR (US)

( * ) Notice: Subject to any disclaimer, the term of this patent is extended or adjusted under 35 U.S.C. 154(b) by 16 days.

(21) Appl. No.: 13/524,715

(22) Filed: Jun. 15, 2012

(65) Prior Publication Data

US 2012/0317898 A1 Dec. 20, 2012

Related U.S. Application Data

(63) Continuation-in-part of application No. 13/356,548, filed on Jan. 23, 2012, now abandoned.

(60) Provisional application No. 61/435,224, filed on Jan. 21, 2011, provisional application No. 61/498,465, filed on Jun. 17, 2011.

(51) Int. Cl.

| | |
|---|---|
| ***E04B 1/344*** | (2006.01) |
| *E04B 1/61* | (2006.01) |
| *E04H 1/12* | (2006.01) |

(52) U.S. Cl.

CPC ..... *E04B 1/3445* (2013.01); *E04B 2001/6191* (2013.01); *E04B 2001/6195* (2013.01); *E04H 2001/1283* (2013.01)

USPC ..... 52/79.5; 52/70; 52/71

(58) Field of Classification Search

USPC ..... 52/64, 69, 70, 71, 79.1, 79.5, 293.3

See application file for complete search history.

(56) References Cited

U.S. PATENT DOCUMENTS

| | | | | | |
|---|---|---|---|---|---|
| 2,259,783 | A | * | 10/1941 | Sparling | 52/69 |
| 2,751,635 | A | * | 6/1956 | Donnahue | 52/69 |
| 3,231,942 | A | * | 2/1966 | O'Brien | 52/70 |
| 3,280,796 | A | * | 10/1966 | Hatcher | 119/499 |
| 3,348,344 | A | * | 10/1967 | Tatevossian | 52/22 |
| 3,498,587 | A | * | 3/1970 | Friedberg | 52/71 |
| 3,731,440 | A | * | 5/1973 | Welz | 52/71 |
| 3,828,502 | A | * | 8/1974 | Carlsson | 52/309.11 |
| 3,984,949 | A | * | 10/1976 | Wahlquist | 52/70 |
| 4,037,385 | A | * | 7/1977 | Wahlquist | 52/745.02 |
| 4,118,901 | A | * | 10/1978 | Johnson | 52/18 |
| 4,145,850 | A | * | 3/1979 | Runyon | 52/71 |
| 4,180,949 | A | * | 1/1980 | Draper, Jr. | 52/67 |
| 4,589,588 | A | * | 5/1986 | Swanhart | 229/122 |
| 4,603,658 | A | * | 8/1986 | Garnsey | 119/499 |

(Continued)

OTHER PUBLICATIONS

Habitaflex Residential Brochure, retrieved on Jan. 18, 2011 at <<http://www.habitaflex.com/varia/ResidentielBrochure_en.pdf>>, 2 pages.

(Continued)

*Primary Examiner* — Charles A Fox
*Assistant Examiner* — Charissa Ahmad
(74) *Attorney, Agent, or Firm* — Lee & Hayes, PLLC

(57) ABSTRACT

A foldable structure is adjustable between a folded condition for storage and shipping, and an unfolded condition for occupation by one or more users. The foldable structure may be substantially prefabricated at a manufacturing facility, transitioned into its folded condition, and placed into a shipping container for shipping to a destination site. A single foldable structure may be placed in the shipping container, or multiple foldable structures may fit in a standard shipping container. For example, in some embodiments, as many as six foldable structures may fit in a single standard shipping container.

11 Claims, 11 Drawing Sheets

(56) References Cited

U.S. PATENT DOCUMENTS

| | | | | |
|---|---|---|---|---|
| 4,989,379 | A * | 2/1991 | Suzuki | 52/66 |
| 6,044,603 | A * | 4/2000 | Bader | 52/309.7 |
| 6,256,960 | B1 * | 7/2001 | Babcock et al. | 52/592.1 |
| 6,434,895 | B1 * | 8/2002 | Hosterman et al. | 52/143 |
| 7,475,514 | B2 * | 1/2009 | Rulquin et al. | 52/79.5 |
| 2009/0014044 | A1 | 1/2009 | Hartman et al. | |
| 2010/0319270 | A1 * | 12/2010 | Slade | 52/71 |

OTHER PUBLICATIONS

Habitaflex Utlitarian Brochure, retrieved on Jan. 18, 2011 at <<http://www.habitaflex.com/varia/UtilitarianBrochure_en.pdf>>, 2 pages.

Habitaflex.com, retrieved on Jan. 19, 2011 @ <<http://www.habitaflex.com/caracteristiques.php>>, 1 page.

* cited by examiner

FOLDABLE STRUCTURE

CROSS REFERENCE TO RELATED APPLICATIONS

This application is a continuation-in-part of U.S. patent application Ser. No. 13/356,548, filed Jan. 23, 2012, which claims priority to Provisional Patent Application No. 61/435,224, filed Jan. 21, 2011. This application also claims priority to U.S. Provisional Patent Application No. 61/498,465, filed on Jun. 17, 2011. All of the foregoing applications are incorporated herein by reference in their entireties.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure relates to a foldable structure that is adjustable between a folded condition for storage and shipping, and an unfolded condition for occupation by one or more users. The foldable structure may be substantially prefabricated at a manufacturing facility, transitioned into its folded condition, and placed into a shipping container for shipping to a destination site. In some embodiments, a single foldable structure may be placed in the shipping container, but in other embodiments multiple foldable structures may fit in a standard shipping container. For example, in some embodiments, as many as six foldable structures may fit in a single standard shipping container.

At the destination site, the foldable structure may be removed from the shipping container, transitioned into its unfolded condition, and anchored to a foundation. In some embodiments, walls of the foldable structure may be anchored directly to a concrete slab or other foundation, without the need for any floor structure. The omission of a floor structure allows the foldable structure to be folded into a more compact folded structure than other prefabricated structures.

Exemplary Foldable Structures

Figure 1:
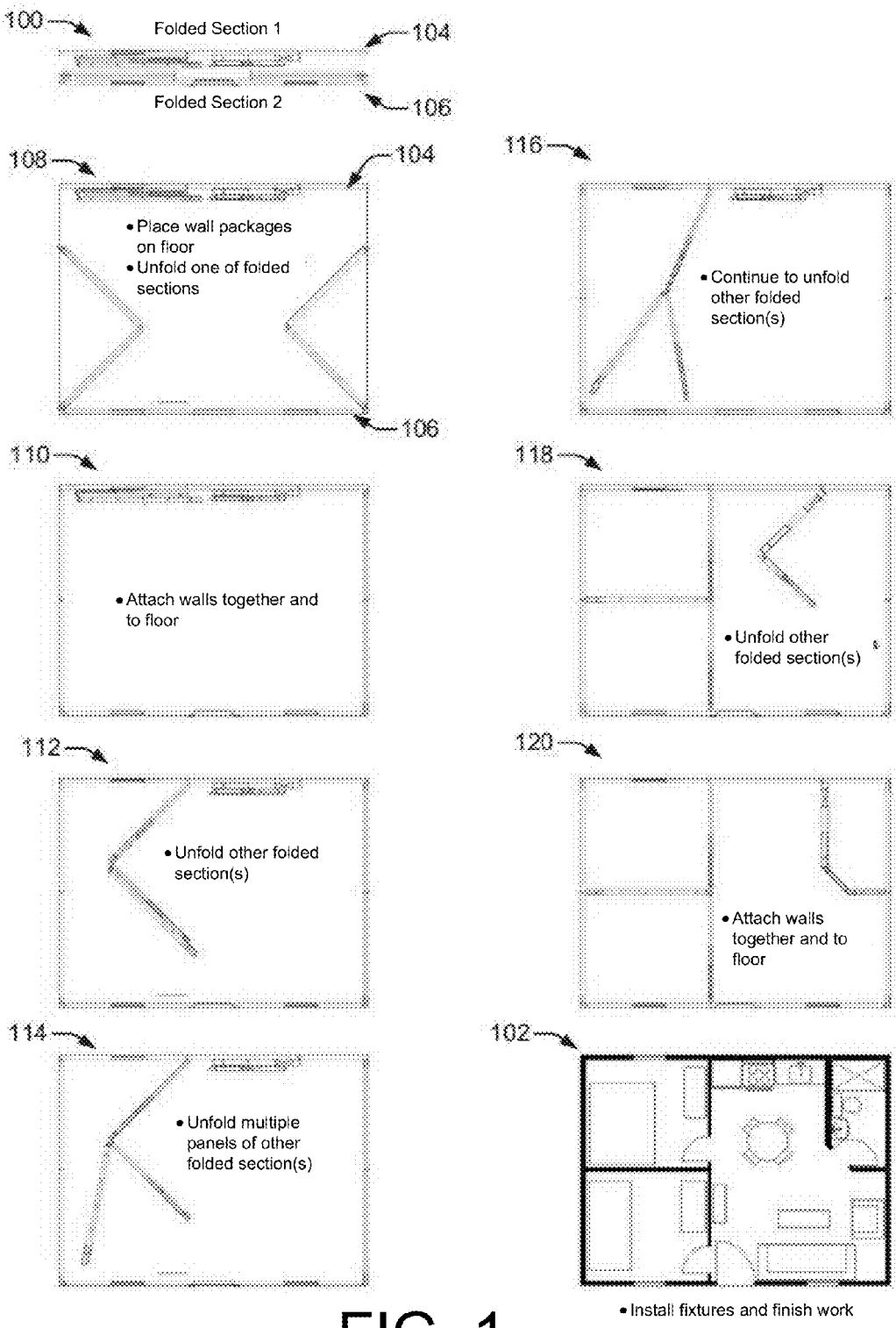
FIG. 1 is a schematic view showing a progression of views of how an example foldable structure transitions from a folded condition to an unfolded condition.

FIG. 1 is a series of illustrations that detail how a foldable structure is formed from two component parts 100 to create a habitable dwelling 102.

A first folding section 104 includes an exterior wall of habitable structure 102 that is pivotably coupled to two interior wall assemblies. The exterior wall may also include windows, doors, and internal chases for mechanical and electrical utilities. The interior wall assemblies may include a plurality of wall panels that are pivotably coupled to each other. In one instance, the wall panels may be pivotably coupled at each end to adjacent walls panels. In a folded condition, the interior wall panels are collapsed to substantially reduce the footprint of the folding section 104. In one instance, the panels are folded to place the panels in parallel to each other, such that the panels are a ¼" apart or up to a ½" apart. In this way, the folding section 104 may be shipped via a shipping container or any other transporting structure.

A second folding section 106 may include an exterior wall that may comprise doors, windows, and internal mechanical or electrical chases to run plumbing lines or electrical lines. The second folding section 106 may also be pivotably coupled to two exterior wall panel assemblies. The exterior wall panel assemblies may include wall panels that are pivotably coupled to each other in an end-to-end manner. As with the interior wall assemblies, the exterior wall assemblies may be folded such that they are about ¼" apart.

Diagram 108 illustrates the unfolding of the folding section 106. In this instance, the exterior wall assemblies are unfolded using hinges that connect the exterior wall panels.

Diagram 110 illustrates the folding section 106 in an unfolded condition in which the exterior walls are set in place on a foundation for the folding structure. In this instance, the unfolded exterior wall panels are coupled to the exterior wall section of the first folding section 104. When the exterior walls are unfolded and connected with the first folding section 106, the exterior walls of the first folding section 104 and the second folding section 106 form the exterior perimeter of the habitable structure.

Diagram 112 illustrates the unfolding of one of the interior wall assemblies. One of the interior wall panels is pivotably coupled to the exterior wall of the first folding section 104. Also, the additional interior wall panels are pivotably coupled to each other in an end-to-end manner. As shown here, the interior wall panels are removed from a folded position to an unfolded position in order to form the interior layout of the habitable structure. Also, in some embodiments, the interior wall panels may also include doors or doorways for the interior spaces.

Diagram 114 also illustrates that more than one interior wall panel may be pivotably coupled to the end of another interior wall panel. As shown here, three wall panels may be pivotably coupled around a single hinge point. Diagram 116 further illustrates how more than two interior wall panels may be pivotably coupled via a single hinge point.

Diagram 118 illustrates the first interior wall assembly is coupled to the exterior walls and how the second wall assembly is transitioned from a folded condition to an unfolded condition.

The first interior wall assembly is coupled to in two different locations along the exterior walls to form two interior spaces for the habitable structure. In one instance, the interior wall panel is coupled to the intersection of the two exterior wall panels of the left exterior wall. In this way, the interior wall covers the intersection or gap between the two walls so that no additional painting or spackling of the exterior wall may be needed.

The second interior wall assembly is also shown being transitioned from a folded condition to an unfold condition. Again, the interior wall panels are pivotably coupled to each other and may be arranged to form another interior space within the habitable structure. As shown in diagram 120, there are three interior spaces created by the two interiors wall assemblies. Additional interior spaces may be created based on the design or layout of interior wall assemblies. Although only two interior wall assemblies are illustrated here, in other embodiments, other foldable habitable structures may include three or more interior wall assemblies.

Diagram 102 illustrates a finished habitable structure that includes furniture and other common features of a single family home. For example, the habitable structure may include a kitchen with a sink, heating appliance, a cooling appliance, and storage space. The exterior and interior walls may have been prefabricated to provide utility connection the illustrated appliances. Further, the habitable structure may also include a bathroom with a toilet, a sink, and a shower or tub.

Figure 2A:
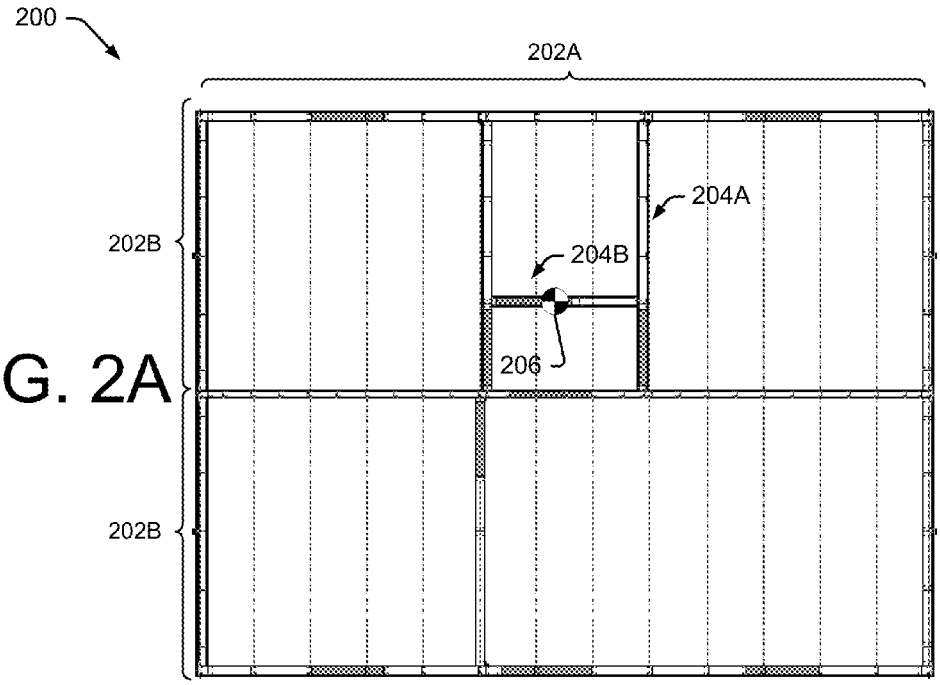
FIG. 2A is a schematic view showing another example foldable structure in a folded condition.
Figure 2B:
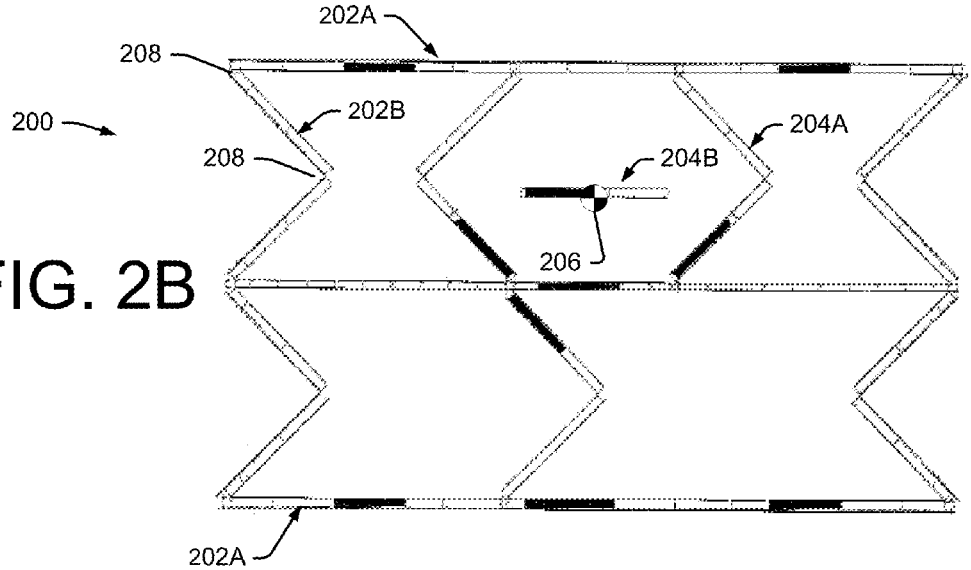
FIG. 2B is a schematic view showing the example foldable structure of FIG. 2A in a partially unfolded condition.
Figure 2C:
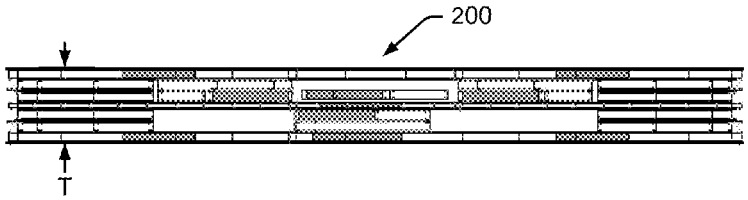
FIG. 2C is a schematic view showing the example foldable structure of FIG. 2A in an unfolded condition.

FIGS. 2A-2C illustrate another example foldable structure 200, which is adjustable between an unfolded condition (FIG. 2A) for use and a folded condition (FIG. 2C) for shipping or storage.

FIG. 2A is a plan view illustrating the foldable structure 200 in an unfolded condition providing an interior usable space for occupation by a user. The foldable structure includes a plurality of exterior walls including a plurality of non-folding exterior walls 202A and a plurality of folding exterior walls 202B (collectively referred to herein as exterior walls 202). The foldable structure also includes one or more interior walls, including non-folding interior walls 204A and folding interior walls 204B (collectively referred to herein as interior walls 204). The walls may be wired/plumbed at the time of manufacturing and/or may be configured with conduit or pass-throughs to facilitate wiring/plumbing onsite. In the illustrated example, one or more water source and/or discharge lines 206 may be located in one of the interior walls, to be connected to water and/or sewer lines at the destination site. In some examples, the plumbing and water supply and/or discharge lines 206 may all be located in a single interior wall to facilitate easy of hookup at the destination site, and to minimize (or eliminate entirely) the number of plumbing connections during installation of the foldable structure 200 at the destination site. However, in other embodiments, walls may be pre-plumbed with flexible tubing to avoid making pluming connections during installation.

FIG. 2B illustrates the foldable structure 200 in a partially folded condition. As shown in FIG. 2B, each of the folding exterior walls 202B and folding interior walls 1204B includes one or more hinges 208 facilitating folding of the folding walls. Also, each of the foldable exterior walls 202B and foldable interior walls 204B is connected to adjoining walls by one or more hinges 208. The hinges 208 may comprise standard door hinges, living hinges, or any other conventional hinges. The hinges 208 may be located on either side of a wall to facilitate folding in the desired direction. Alternatively, the hinges 208 may comprise compound hinges that facilitate folding in either direction. Additionally or alternatively, some or all of the hinges 208 may include locks to lock the hinges in the folded and/or unfolded conditions for additional stability in the unfolded condition and/or to minimize movement of the foldable structure for ease of handling during shipping.

FIG. 2C is a plan view of the foldable structure of FIG. 2A in a folded condition for shipping or storage. In the folded condition, the foldable structure 200 has a thickness T which is substantially less than that of the unfolded structure. For example, in some embodiments, in the folded condition the foldable structure 200 may have a smallest dimension which is at most about ⅙th that of the same dimension in the unfolded condition. In some embodiments, the smallest dimension in the folded condition may be at most about 1 meter. In some embodiments, the foldable structure 200 may be sized to occupy at most about ¼ of the volume of a standard shipping container, while in still other embodiments, the foldable structure is sized to occupy at most about ⅙ of the volume of a standard shipping container.

In the unfolded condition, the folding exterior walls 202B are unfolded such that the non-folding exterior walls 202A are spaced apart from one another to define an interior space of the foldable structure. The exterior walls 202 are configured to be anchored in this condition to a foundation (not shown in this figure). In the folded condition, the folding exterior walls 202B are folded such that the non-folding exterior walls 202A are collapsed together substantially eliminating the interior space of the foldable structure.

In the unfolded condition, the interior walls 204 define one or more rooms in the interior space of the foldable structure 200. In the folded condition, the folding interior walls 204B fold to allow the non-folding exterior walls 202A and the non-folding interior walls 204A to be collapsed together substantially eliminating the interior space of the foldable structure.

In the illustrated example, some walls are shows as being non-foldable walls, while other walls are shown as being foldable walls. However, in other examples, any or all of the interior and/or exterior walls may comprise folding walls. In still other embodiments, any or all of the walls may comprise non-foldable walls coupled together by hinges such that the walls are foldable relative to one another.

Figure 3A:
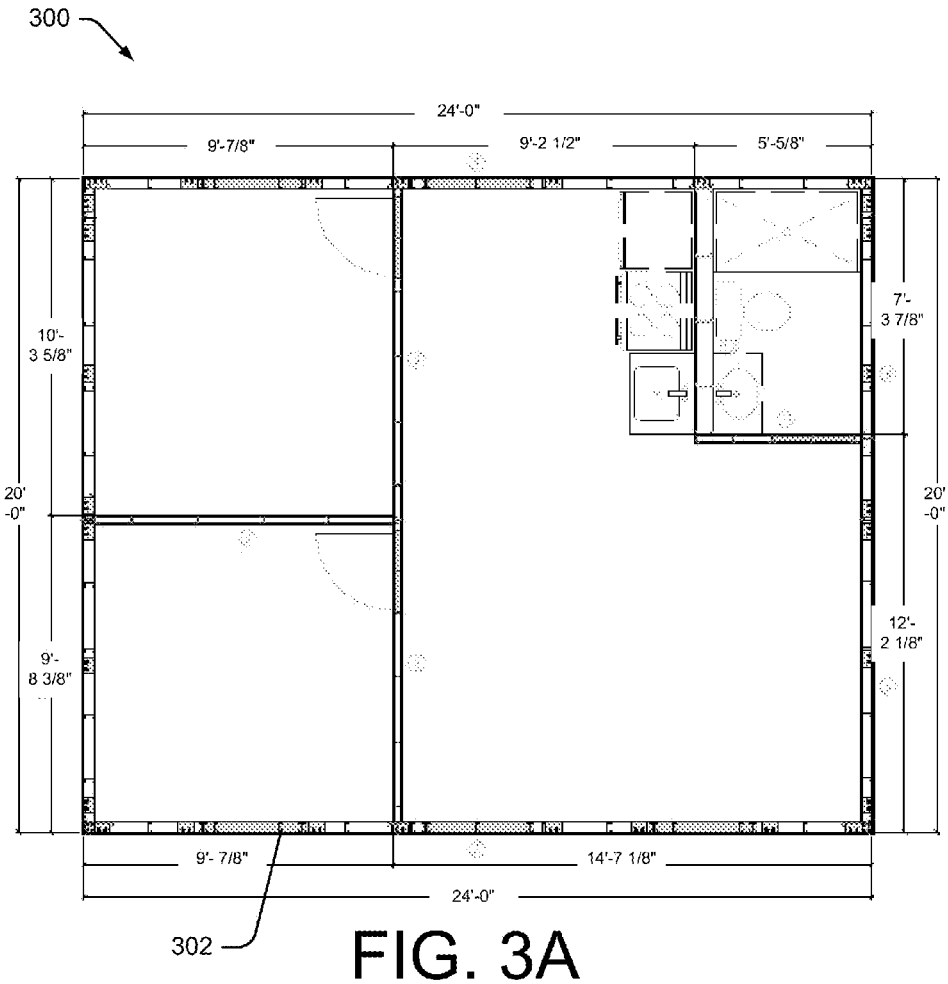
FIG. 3A is a schematic view showing another example foldable structure in an unfolded condition.
Figure 3B:
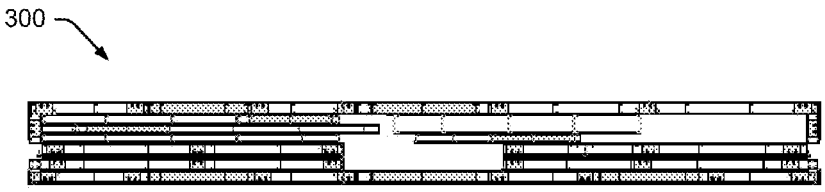
FIG. 3B is a schematic view showing the example foldable structure of FIG. 3A in a folded condition.

FIGS. 3A and 3B illustrate yet another example of a foldable structure 300 in an unfolded condition and a folded condition, respectively. The foldable structure 300 has a different floor plan and folds differently than the foldable structures 102 and 200 described above. Also, the walls in this embodiment are shown to include markings 302 designating locations for roof trusses, second story floor joists (if applicable), and/or rafters. In various examples, the roof may comprise a pitched roof (e.g., gabled, Hip, shed, etc.), a flat roof, or any other desired roof type, and the trusses or rafters used may be chosen according to the type of roof used. Moreover, FIG. 3A includes illustrative dimensions, and depicts several illustrative fixtures that may be installed in the foldable structure, such as a toilet, kitchen skin, bathroom sink, stove, and the like. However, the illustrated dimensions and fixtures are merely illustrative and foldable structures according to this disclosure may be constructed in a variety of other smaller and larger sizes, and may include any combination of these and other fixtures. In all other respects, the foldable structure 300 of FIGS. 3A and 3B may be constructed using any of the techniques and structures described above with respect to FIG. 1 and FIGS. 2A-2C. Thus, for the sake of brevity, FIGS. 3A and 3B will not be described further herein.

Thus, in some embodiments, two, four, or even six foldable structures may fit in a single standard shipping container. For example, six approximately 500 square foot foldable structures, having two bedrooms and a kitchen, such as that shown in FIGS. 3A and 3B, can fit in a single standard shipping container. In such an example, the foldable structures may have unfolded dimensions of about 20 feet wide, about 24.5 feet long, and up to 8.8 feet tall, and a wall thickness of about 4.5 inches. Thus, in a folded condition, each foldable structure would have dimensions of at most about 2.7 feet wide, at most about 26 feet long, and at most about 8.8 feet tall. As such, six of the folded structures may be placed two-deep and three-wide into a standard 53 foot High Cube shipping container (having interior dimensions of about 52.5 feet long, about 8.2 feet wide, and about 9.1 feet tall). Of course, if different room configurations, different wall thicknesses, different room sizes and/or different shipping containers are used, different numbers of structures (1, 2, 3, 4, 5, 6, 7, 8, or even more than 8) can be made to fit within a single standard shipping container.

Exemplary Installation

Figure 4:
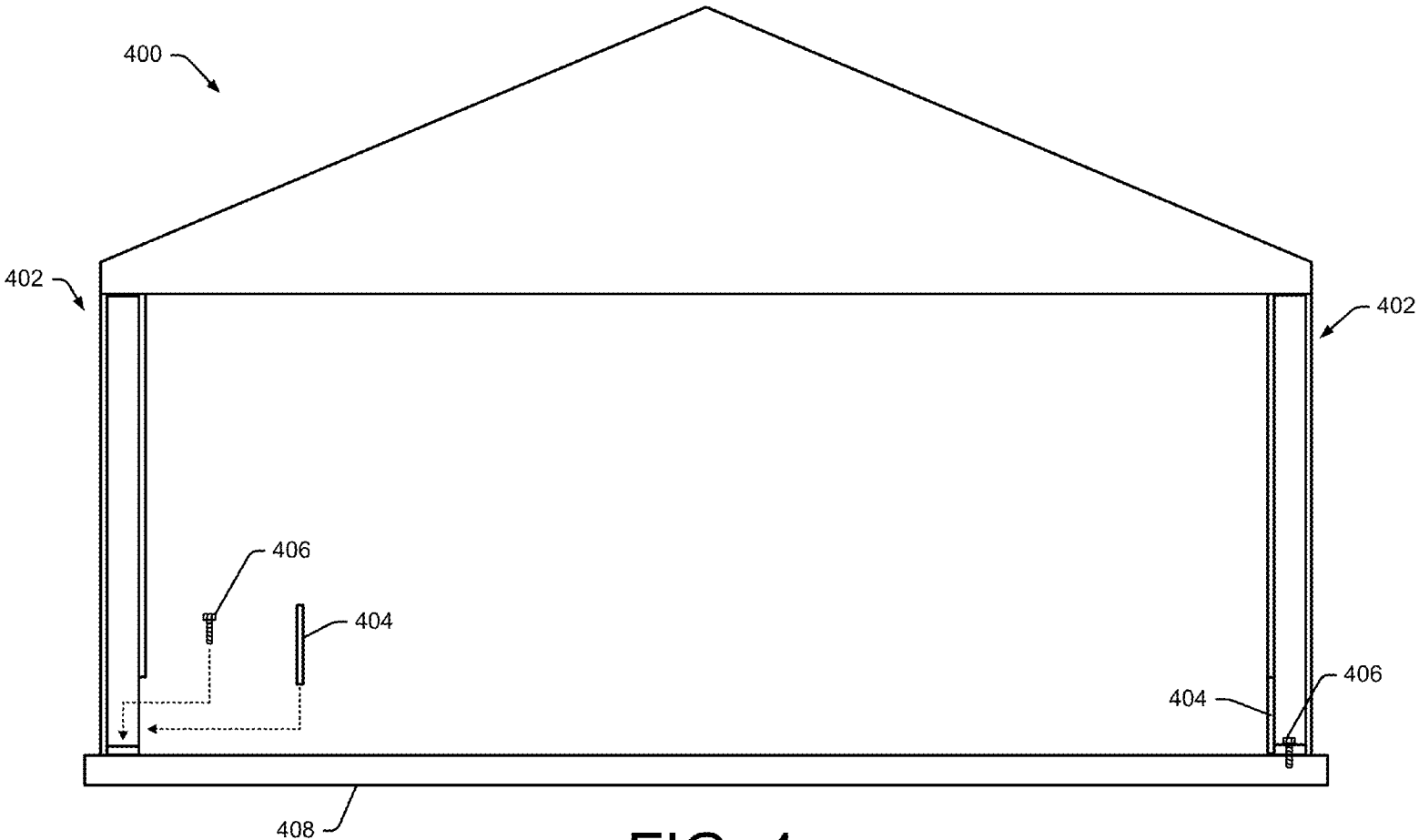
FIG. 4 is a cross-sectional view of another example foldable structure in an unfolded condition.
Figure 5:
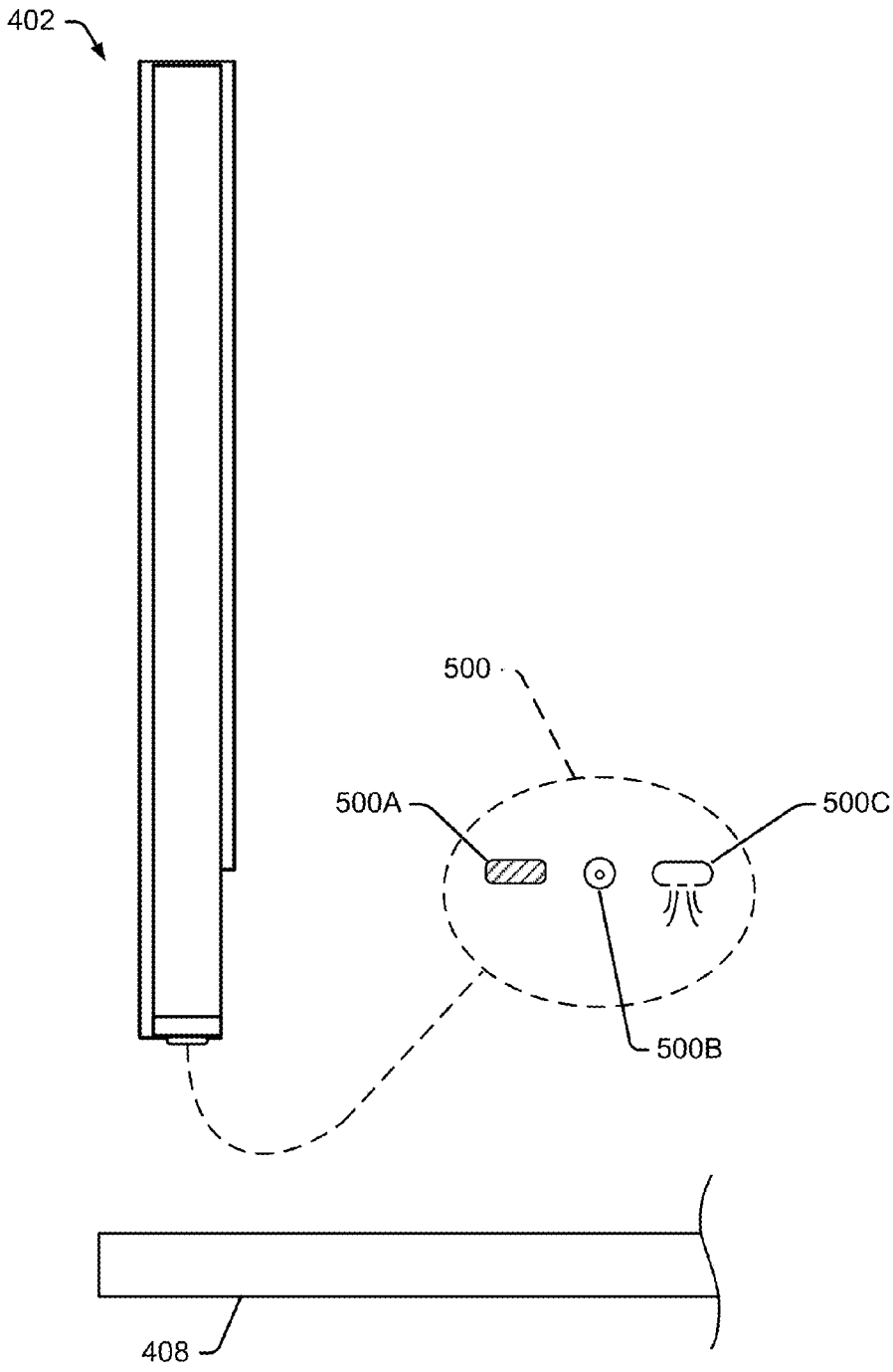
FIG. 5 is a partial cross-sectional view showing a wall of the foldable structure of FIG. 4 in an exploded view.

FIGS. 4 and 5 illustrate aspects of the installation or setup of a foldable structure, such as the foldable structures 102, 200, and 300. FIG. 4 is a cross-sectional view of another example foldable structure 400 in an unfolded condition. In this example, the foldable structure 400 includes a plurality of walls 402. Interior walls have been omitted in this figure for clarity. The walls 402 may comprise wallboard, such as magnesium oxide board ("mag board"), gypsum board, exterior siding, wood paneling, combinations of any of the foregoing, or the like, coupled to a metal or wood frame. Regardless of their method of construction, the walls 402 may include an access panel 404, by which an installer can install an anchor 406, such as, for example, a lag bolt, concrete nail, or other concrete anchor to secure the foldable structure 400 to a concrete slab or other foundation 408. In one example, anchor 406 may comprise a Strong-Bolt™ wedge anchor, available from Simpson Strong-Tie of Pleasanton, Calif. The left wall 402 shown in FIG. 4 is shown with the access panel 404 removed for installation of the anchor 406. The right wall 402 shown in FIG. 4 is shown with the anchor 406 installed and the access panel 404 in place.

The walls 402 may have varying thicknesses, depending on local building codes, insulation requirements, structural requirements, and the like. In some embodiments, the total wall thickness may be between about 2.5 inches and about 6.5 inches. Smaller wall thicknesses will facilitate packaging larger numbers of foldable structures in a single shipping container. In contrast, greater wall thicknesses may be used for multi-story structures and/or where greater insulation is desired.

As shown in FIG. 4, the walls of the foldable structure 400 may sit directly on the concrete slab or other foundation 308 (with or without a gasket or other seal along the bottom edge of the wall), without the need for any other floor structure. Rather, floor coverings may be applied directly on top of the concrete slab.

FIG. 5 is a partial cross-sectional view showing a wall of the foldable structure of FIG. 4 in an exploded view, and showing details of example slide mechanisms 500 to facilitate transitioning of the foldable structure between the folded and unfolded conditions. In various embodiments, the slide mechanism 500 may include a low friction skids 500A (e.g., made of Teflon), rollers 500B, or air bearings 500C. Air bearings 500C are configured to introduce a stream of air between the bottom surface of the wall and the concrete slab or other foundation (analogous to the operation of an air hockey table) to allow the walls to be moved more easily during installation. Air bearings 500C may be constructed in a variety of ways. In one example, an air bearing 500C may comprise a flexible tube with a plurality of air holes protruding from a bottom surface thereof. In such an embodiment, after the air bearing 500C has been used to move the walls into the unfolded condition, the air bearing 500C may be left in place and may form a gasket or seal between the bottom surface of the walls and the concrete slab or other foundation once the foldable structure is anchored.

Figure 6:
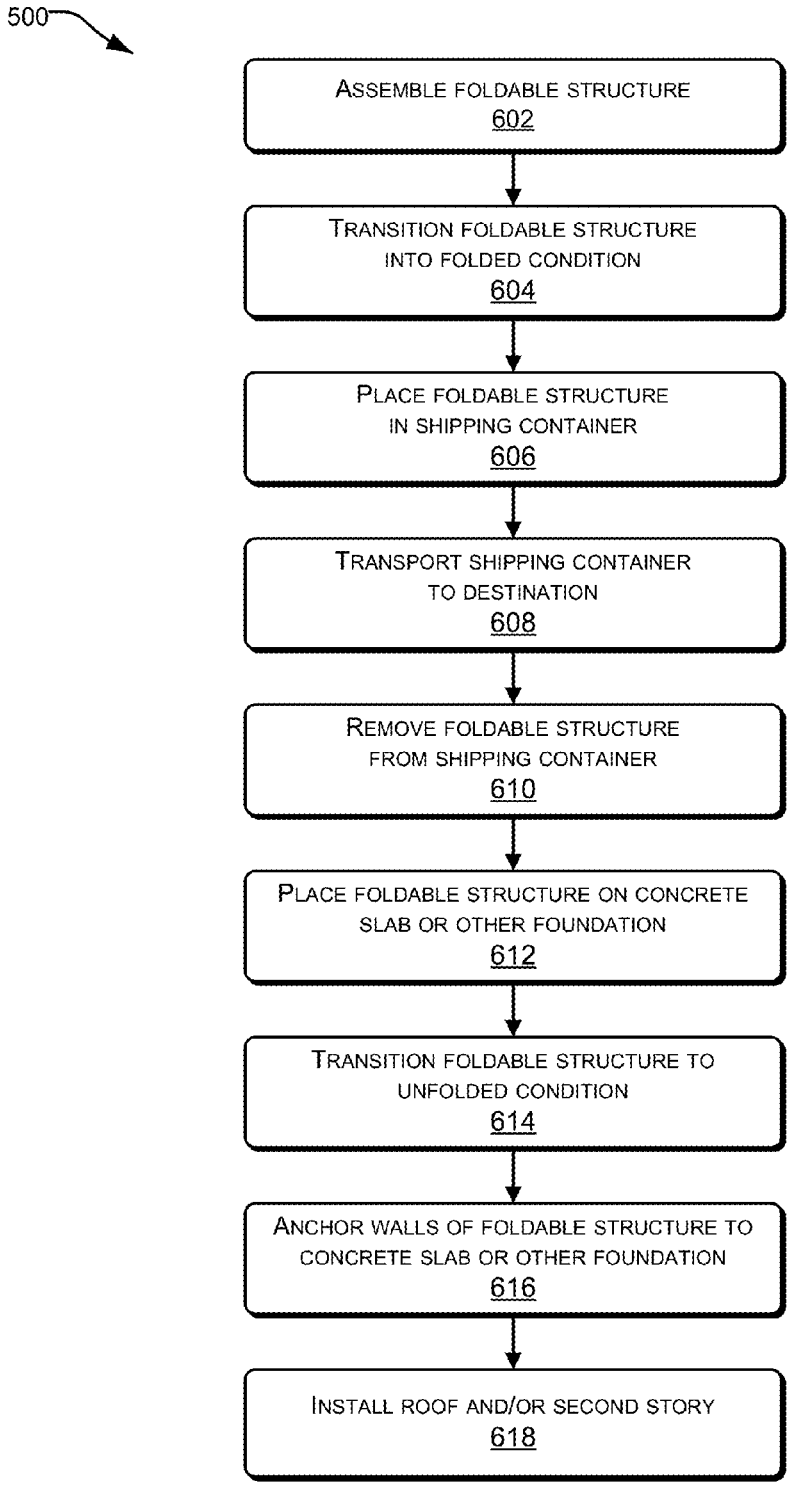
FIG. 6 is a flow chart of an example method of installing a foldable structure.

FIG. 6 is a flow chart of an example method 600 of installing a foldable structure, such as those shown in FIGS. 1, 2A-2C, 3A, 3B, 4, and 5. The operations shown in method 600 begin, at 602, with assembling a foldable structure. At 604, the foldable structure if transitioned from an unfolded (i.e., use) condition to a folded condition. At 606, the foldable structure is placed in a shipping container (alone or with one or more other foldable structures). The shipping container is then transported, at 608, to a destination. At 610, one or more foldable structures are removed from the shipping container and, at 612, placed on a concrete slab or other foundation. At 614, the foldable structure is transitioned to the unfolded condition. At 616, the foldable structure is anchored to the concrete slab or other foundation. At 618, a roof or secondary story may be installed on the foldable structure. In some examples, the roof or secondary story may be transported in the same or different shipping container as the foldable structure.

Example Anchoring Technique of Exemplary Structure

Figure 7:
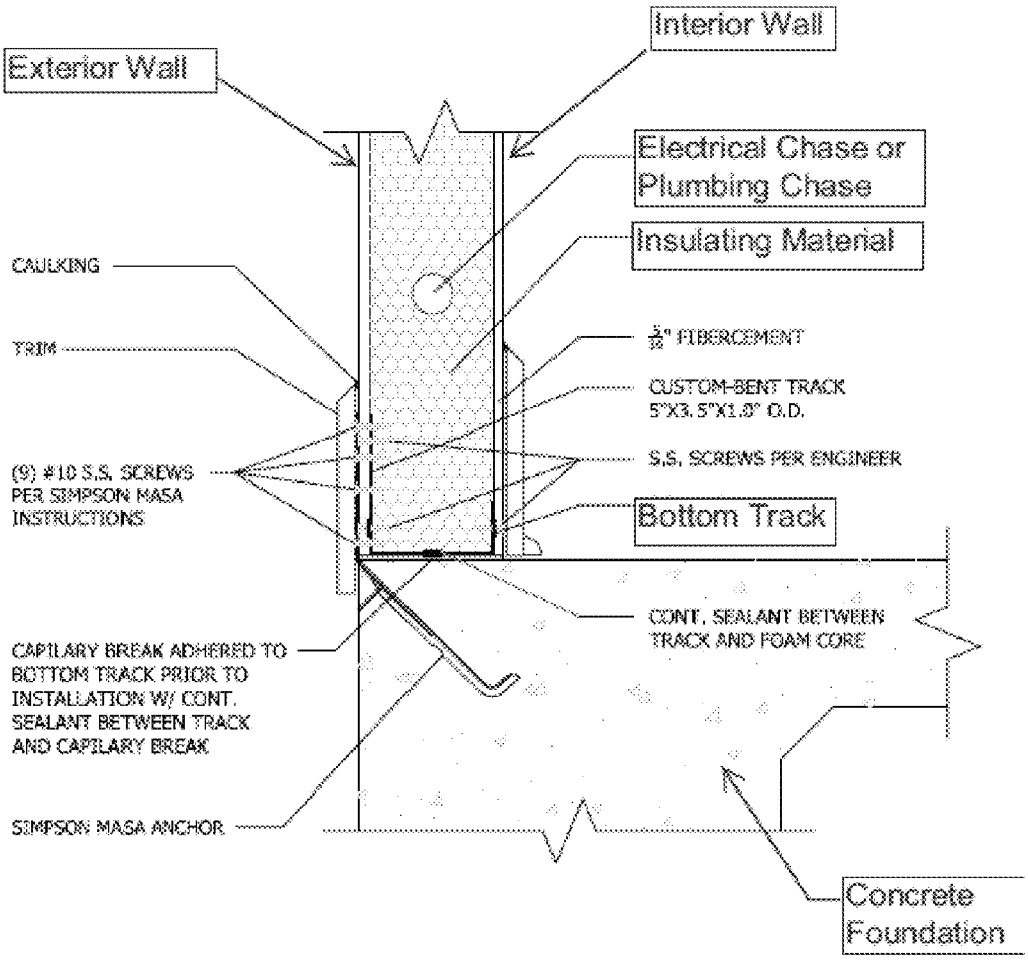
FIG. 7 is a schematic diagram of an example anchoring technique to secure the exterior or interior walls of a structure to a foundation.

FIG. 7 illustrates an exemplary anchoring technique to secure the exterior or interior walls of a structure, such as but not limited to the foldable structures 102, 200, 300, and 400 described above, to a foundation. In this illustrated example, an exterior wall is shown to be secured to a concrete foundation using an anchor embedded in the concrete. In one embodiment, the anchor may be a Simpson Masa Anchor, a Simpson Strap-Tie Hold Down (STHD) anchor, or a Simpson LST anchor. In this example, one end of the anchor is embedded in the concrete at an angle between 30 and 60 degrees. The opposing end of the anchor is coupled to an exterior vertical surface of the exterior wall. In this example, the exterior wall is a structural insulated panel (SIP) which may include two vertical walls coupled together via a top plate and a bottom plate at the ends of the walls. In one example, the top plate and bottom plate may be u-channel pieces of steel or other metal alloy that are secured to the bottom or top edges of each wall board to create an enclosure that includes insulating material. The insulating material may also include chases for electrical wiring or plumbing. Although a SIP panel is shown by example, any type of wall may be anchored to the foundation in this way. The walls may be wood frame or steel frame walls or even composite frame walls.

The structural insulated panels may comprise drywall board, magnesium oxide wall board, or even siding (vinyl, steel, fiber cement). In this example, the exterior and interior walls are shown as fiber cement wall boards. However, in other instances, the type of wall boards may be arranged in any permutation between the wall board options mentioned above. In one specific example, the exterior surface wall may be fiber cement and the interior surface wall may be drywall board.

Following the coupling of the anchor to the exterior wall of the structural insulated panel, a trim board may be coupled to the wall board that covers the lower edge of the wall, such that the anchor is not visible. Caulk may be applied to the edges of the trim to prevent water from reaching the anchor or the foundation. Water leakage may also be prevented by a capillary break installed on bottom plate of the structural insulated panel prior to securing the panel to the foundation. Also, an interior trim may be secured to the bottom portion of the interior wall of the structural insulated panel.

Exemplary Wall Securing Techniques

Figure 8:
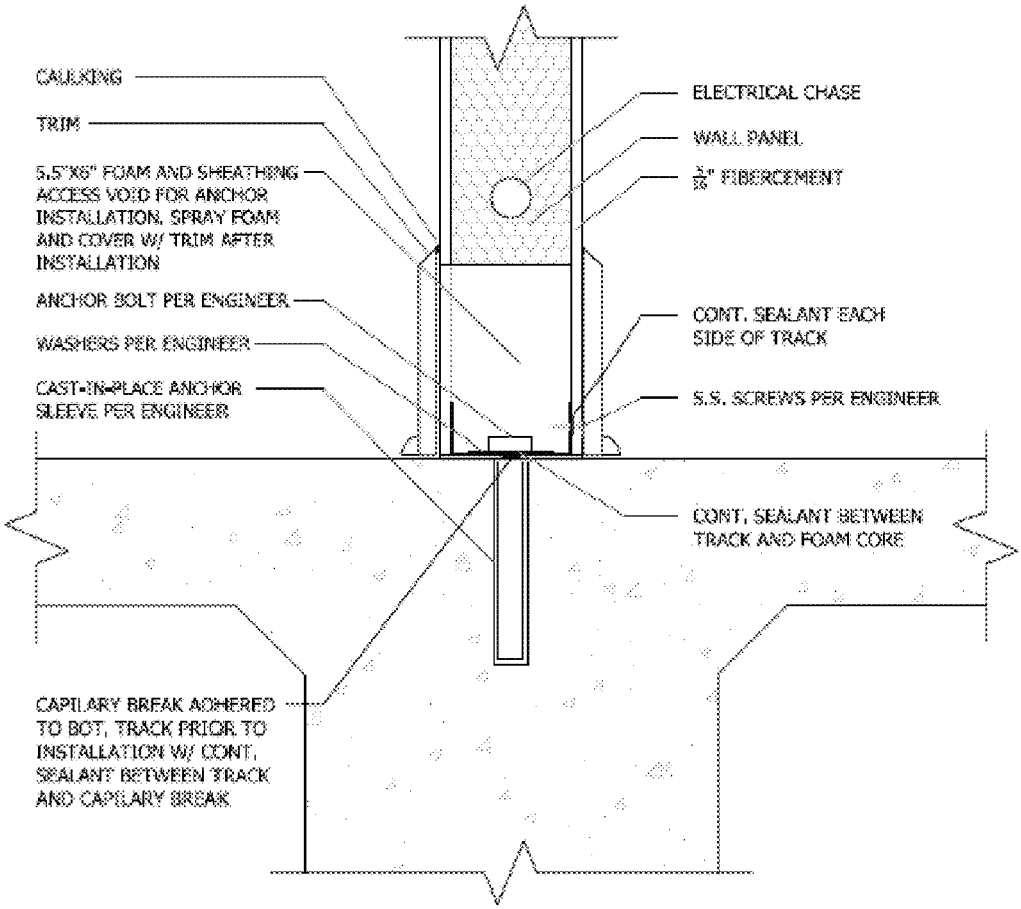
FIG. 8 is a schematic diagram of an example interior wall structurally insulated panel (SIP) that includes an access void at the bottom of the panel for anchor installation.
Figure 9:
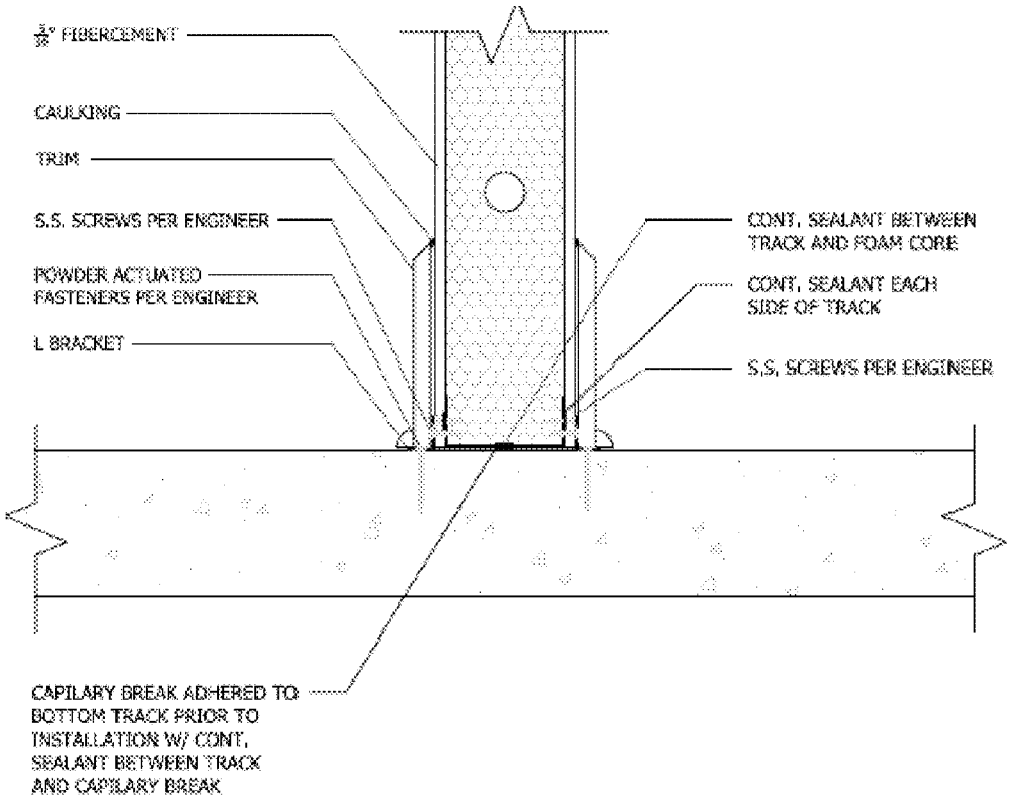
FIG. 9 is a schematic diagram of an example technique for securing an interior wall panel to a foundation by attaching L-brackets at the base of the wall and securing the brackets to the foundation using cement screws.

FIGS. 8 and 9 illustrate additional wall securing techniques. These techniques are illustrated as securing interior walls of a structure, however they may also be used to secure exterior walls as well.

FIG. 8 illustrates an interior wall SIP panel that includes an access void at the bottom of the panel for anchor installation. In this embodiment, a cast-in-place anchor sleeve is cast into the concrete foundation. Once the interior wall is placed into position, an anchor bolt secures the bottom plate of the interior wall to the foundation. Then additional spray foam is used to fill the access void and is covered with trim to provide a finished appearance consistent with the trim pre-installed on the interior wall panel.

FIG. 9 illustrates securing an interior wall panel to a foundation by attaching L-brackets at the base of the wall and securing the brackets to the foundation using cement screws. After the wall is secured to the foundation, trim is installed along the base of the wall which covers up the L-brackets and the screws.

Figure 10:
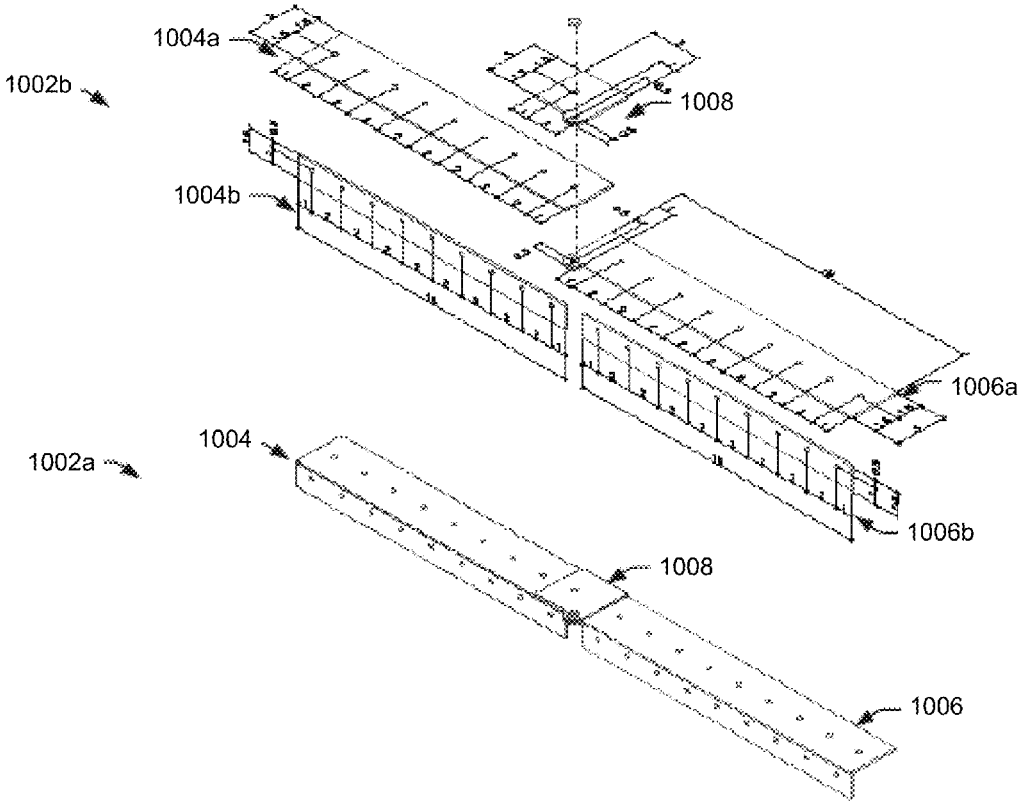
FIG. 10 is a schematic diagram of an example hinge that may be used to couple the top and/or bottom of foldable wall panels together.

FIG. 10 illustrates a hinge that may be used to couple the top and/or bottom of foldable wall panels, such as those shown in FIGS. 1, 2A-2C, 3A and 3B. The hinge pivotably couples the wall panels together to enable them to be folded together in a parallel manner about a ¼" apart from each other. When unfolding the wall panels the hinge enables the wall panels to be placed end-to-end to form a wall for the structure. Diagram 1002*a* is an isometric view of the hinge, while diagram 1002*b* is an exploded isometric view of the hinge. Also, the hinge may be used with other types of materials that may be pivotably coupled together, not just wall panels.

The hinge may include two L-brackets 1004 and 1006 coupled together around a hinge point 1008. Each of the brackets includes screw holes along the lateral axis of along each section of the bracket as illustrated in diagram 1002*b*. In one instance the hinge 1000 is secured to the top of two panels using the screw holes on the top portion of the hinge. In short, the screws are placed through the bracket and are secured to the top plate of each panel. A bottom hinge is secured using the screw holes on the side of the hinge. Therefore, once the wall is set in position, the screws can be removed from the side and the hinge can be removed from the wall panel prior to securing the wall panel to the foundation.

In the exploded view 1002*b*, each portion of the hinge is shown separately. For example, L-bracket 1004 is shown in individual pieces 1004*a* and 1004*b* and L-bracket 1006 is shown in individual pieces 1006*a* and 1006*b*. Although each bracket shows a single line of screw holes down the center of the individual pieces, the holes may be aligned in a configuration that may provide increased lateral support over a wider area. Hinge part 1006 is coupled to part 1004*a* to provide a hinge hole for bracket 1004. In this way, it allows part 1004*a* and 1006*a* to fit flush end-to-end against each other. As shown in part 1006*a*, the hinge hole is incorporated into the part 1006*a*. Accordingly, the hinge hole in part 1006*a* is aligned above the hinge hole in part 1006*a* so that a hinge pin may be fed through the holes to pivotably couple bracket 1004 and bracket 1006.

Figure 11:
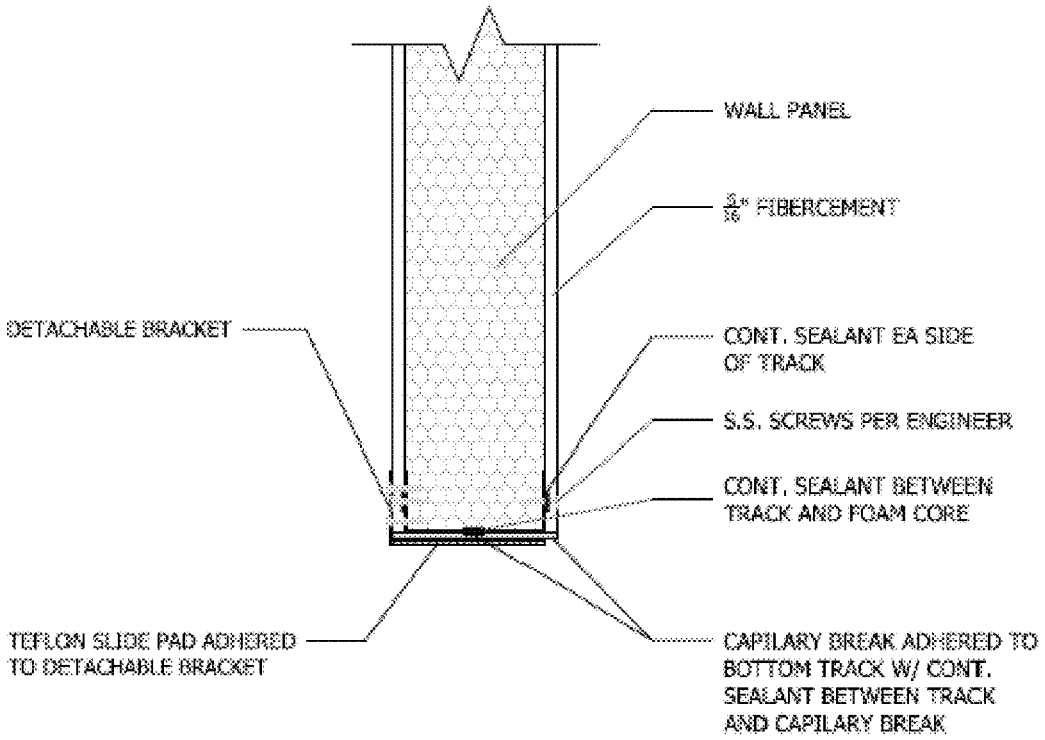
FIG. 11 is a schematic diagram of an example wear resistance bracket attached to the bottom of a wall panel.

FIG. 11 illustrates a wear resistance bracket attached to the bottom of a wall panel. In one instance, an L-bracket is coupled to the lower portion of the wall panel by being coupled to the side of one of the panels for a structural insulated panel. The bracket may run along the entire bottom portion of the panel or a plurality of smaller brackets may be strategically located along the bottom portion of the panel. The wear resistance bracket protects the capillary break and the bottom portion of the panel from damage during installation. Once the panel is positioned in place, the wear resistance bracket may be removed.

In this illustrated embodiment, a wear resistant pad is coupled to a side of the bracket that is opposite of the side that is flush with the capillary break. The pad may be comprised of any wear resistant material. In one specific example, the pad may be comprised of polytetrafluoroethylene (PTFE).

Conclusion

Although the embodiments have been described in language specific to structural features and/or methodological acts, is the claims are not necessarily limited to the specific features or acts described. Rather, the specific features and acts are disclosed as illustrative forms of implementing the subject matter described in the disclosure.

What is claimed is:

1. A collapsible structure comprising:

at least two finished closed panel walls of the collapsible structure that can be arranged into an expanded state and a collapsed state, each finished closed panel wall comprising:

a first panel wall;

a second panel wall;

a top plate coupled to one end of the first panel wall and the second panel wall;

a bottom plate coupled to another end of the first panel wall and the second panel wall;

an upper hinge coupled to the top plate of a first finished closed panel wall and to the top plate of a second finished closed panel wall, the upper hinge comprising:

a first angle bracket including a hinge hole, the first angle bracket being secured along at least one lateral axis to the top plate of the first finished closed panel wall using a plurality of coupling devices;

a second angle bracket including a hinge hole, the second angle bracket being secured along at least one lateral axis to the top plate of the second finished closed panel wall using a plurality of coupling devices and a hinge hole; and a hinge pin that pivotably couples the first angle bracket and the second angle bracket that enables the first finished closed panel wall and the second finished closed panel wall to fit flush end-to-end with each other in the expanded state and to be parallel with each other in the collapsed state; and a lower hinge coupled to the bottom plate of the first finished closed panel wall and the bottom plate of the second finished closed panel wall.

2. The collapsible structure of claim 1, wherein the lower hinge further comprises:

a first angle bracket including a hinge hole, the first angle bracket secured to the first panel wall of the first finished closed panel wall using a plurality of coupling devices;

a second angle bracket including a hinge hole, the second angle bracket secured to the first panel wall of the second finished closed panel wall using a plurality of coupling devices and a hinge hole; and a hinge pin that pivotably couples the first angle bracket and the second angle bracket via their respective hinge holes which enables the first finished closed panel wall and the second finished closed panel wall to fit flush end-to-end with each other in the expanded state and to be parallel with each other in the collapsed state.

3. The collapsible structure of claim 1, wherein the hinge hole of the first angle bracket is offset from an edge of the first angle bracket and the hinge hole of the second angle bracket is offset from an edge of the second angle bracket.

4. The collapsible structure of claim 3, wherein the hinge pin pivotably couples the first angle bracket and the second angle bracket when the hinge hole of the first angle bracket and the hinge hole of the second angle bracket are vertically aligned to accept the hinge pin.

5. The collapsible structure of claim 1, wherein the finished closed panel wall further comprises insulation material enclosed within the first panel and second panel.

6. The collapsible structure of claim 1, wherein the collapsed state the two finished closed panel walls are apart by not more than 1".

7. A collapsible structure comprising:

at least two finished closed panel walls that can be arranged into an expanded state and a collapsed state, each finished closed panel wall comprising:

a first panel wall;

a second panel wall;

a top plate coupled to one end of each of the first panel wall and the second panel wall;

a bottom plate coupled to another end of each of the first panel wall and the second panel wall; and insulation material enclosed between the first panel wall and second panel wall;

an upper hinge coupled to the top plate of a first finished closed panel wall and to the top plate of a second finished closed panel wall, the upper hinge comprising:

a first angle bracket including a hinge hole, the first angle bracket being secured along at least one lateral axis to the top plate of the first finished closed panel wall using a plurality of coupling devices;

a second angle bracket including a hinge hole, the second angle bracket being secured along at least one lateral axis to the top plate of the second finished closed panel wall using a plurality of coupling devices and a hinge hole; and a hinge pin that pivotably couples the first angle bracket and the second angle bracket that enables the first finished closed panel wall and the second finished closed panel wall to fit flush end-to-end with each other in the expanded state and to be parallel with each other in the collapsed state; and a lower hinge coupled to the bottom plate of the first finished closed panel wall and the bottom plate of the second finished closed panel wall.

8. The collapsible structure of claim 7, wherein the lower hinge further comprises:

a first angle bracket including a hinge hole, the first angle bracket secured to the first panel wall of the first finished closed panel wall using a plurality of coupling devices;

a second angle bracket including a hinge hole, the second angle bracket secured to the first panel wall of the second finished closed panel wall using a plurality of coupling devices and a hinge hole; and a hinge pin that pivotably couples the first angle bracket and the second angle bracket via their respective hinge holes which enables the first finished closed panel wall and the second finished closed panel wall to fit flush end-to-end with each other in the expanded state and to be parallel with each other in the collapsed state.

9. The collapsible structure of claim 7, wherein the hinge hole of the first angle bracket is offset from an edge of the first angle bracket and the hinge hole of the second angle bracket is offset from an edge of the second angle bracket.

10. The collapsible structure of claim 9, wherein the hinge pin pivotably couples the first angle bracket and the second angle bracket when the hinge hole of the first angle bracket and the hinge hole of the second angle bracket are vertically aligned to accept the hinge pin.

11. The collapsible structure of claim 7, wherein in the collapsed state the two finished closed panel walls are apart by at most 1".

* * * * *